US006474417B1

(12) United States Patent
Blair et al.

(10) Patent No.: US 6,474,417 B1
(45) Date of Patent: Nov. 5, 2002

(54) SUBSEA TREE COUPLING FOR MUDLINE SUSPENSION SYSTEM

(75) Inventors: Richard Blair, Glasgow (GB); William Gourley Cherrie, Midlothian (GB); James Tait, Fife (GB)

(73) Assignee: FMC Corporation, Chicago, IL (US)

( * ) Notice: Subject to any disclaimer, the term of this patent is extended or adjusted under 35 U.S.C. 154(b) by 0 days.

(21) Appl. No.: 09/644,493

(22) Filed: Aug. 23, 2000

(30) Foreign Application Priority Data

Aug. 24, 1999 (GB) ..... 9920045

(51) Int. Cl.[7] ..... E21B 33/038; E21B 33/035
(52) U.S. Cl. ..... 166/368; 166/75.13
(58) Field of Search ..... 166/368, 382, 166/75.14, 75.13, 208

(56) References Cited

U.S. PATENT DOCUMENTS 3,918,747 A * 11/1975 Putch ..... 285/4
4,550,782 A * 11/1985 Lawson ..... 166/382
4,580,630 A * 4/1986 Milberger et al. ..... 166/208
4,651,831 A * 3/1987 Baugh ..... 166/344
4,653,589 A * 3/1987 Alandy ..... 166/382
4,718,971 A * 1/1988 Owens ..... 166/191
4,781,387 A * 11/1988 Braugh ..... 277/12
5,076,356 A 12/1991 Reimert
5,127,478 A * 7/1992 Miller ..... 166/348
5,240,081 A * 8/1993 Milbereger et al. ..... 175/8
5,330,002 A * 7/1994 Saunders ..... 166/208
5,620,052 A * 4/1997 Turner ..... 166/348
5,655,603 A 8/1997 Schulte et al.
5,687,794 A 11/1997 Watkins et al.
5,971,077 A * 10/1999 Lilley ..... 166/368
6,227,300 B1 * 5/2001 Cunningham et al. ..... 166/339

FOREIGN PATENT DOCUMENTS

GB 2 311 312 9/1997 ..... E21B/43/16

* cited by examiner

*Primary Examiner*—David Bagnell
*Assistant Examiner*—Jennifer H Gay
(74) *Attorney, Agent, or Firm*—Pauley Petersen Kinne & Erickson

(57) ABSTRACT

A subsea Christmas tree coupling having a radially outer connection, for example a tree surface and a conductor housing, adapted to make a rigid joint with a conductor casing. A radially inner connection, for example a depending skirt of the subsea Christmas tree, is adapted to make a sealed joint directly with a casing hanger assembly of a mudline suspension system. The invention thus substantially eliminates the use of additional hangers besides those of the mudline suspension system, simplifying the coupling assembly, and providing the possibility of reduced stackup heights. The relatively compact and simple coupling results in shorter installation times and lower costs. The rigid joint between the coupling and the conductor casing ensures that any external loading is transferred to the conductor casing.

19 Claims, 5 Drawing Sheets

SUBSEA TREE COUPLING FOR MUDLINE SUSPENSION SYSTEM

FIELD OF THE INVENTION

This invention relates to mudline suspension systems such as typically are used in drilling, temporary abandonment and completion operations conducted from a jack-up rig or other bottom supported platform in offshore oil and gas production. More particularly, the invention provides a means for adapting such systems for connection to a subsea wellhead, without the use of tieback hangers.

BACKGROUND OF THE INVENTION

In a mudline suspension system the casing and tubing strings are suspended at or near the mudline, from hangers respectively supported on landing shoulders each located near the top of the next outer casing string. In production mode, the hangers are usually tied back to a surface wellhead on the rig or production platform. Sometimes however (e.g. in satellite wells), a subsea wellhead may be employed. For this purpose, an adapter wellhead is secured to the upper end of the conductor casing. A rigidizing mechanism ensures that externally applied loads on the adapter wellhead are transferred to the conductor casing. Hangers of the mudline suspension system are tied back to further hangers and packoffs received in the adapter wellhead. The adjustment required to tie back the mudline suspension system to the adapter wellhead is provided by adjustment subs accommodated in the adapter wellhead/conductor casing. A subsea Christmas tree is then secured and sealed to the adapter wellhead.

The resulting large stackup height can give difficulties in providing trawl protection. Also, duplication of hangers and provision of adjustment subs leads to a relatively large and complex assembly. Present designs of subsea completions are intended primarily for deeper water vessels, rather than for jack up deployment in shallower waters. Although such completions, including the required adapter wellheads, can be deployed from jack-ups, their bulk and weight lead to handling difficulties and increased capital/operational costs.

SUMMARY OF THE INVENTION

In accordance with the present invention there is provided a subsea Christmas tree coupling for mounting upon a mudline suspension system, having a radially outer connection adapted to make a rigid joint with a conductor casing and a radially inner connection adapted to make a sealed joint directly with a casing hanger assembly of the mudline suspension system without the use of a tieback hanger. The invention thus substantially eliminates the use of additional hangers besides those of the mudline suspension system, simplifying the coupling assembly, and providing the possibility of reduced stackup heights. The relatively compact and simple coupling thus obtained gives shorter installation times and lower costs. The rigid joint between the coupling and the conductor casing ensures that any external loading is transferred to the conductor casing.

Preferably the radially outer connection is made in use with a conductor housing attached to the conductor casing and in which the coupling is rigidly received.

The coupling may be an integral part of a subsea Christmas tree, or a separate tree may be mounted upon the coupling.

The tree may be either of horizontal or non-horizontal (i.e. conventional) configuration. In the case of a horizontal tree, the tubing is suspended from a hanger including a lateral production fluid outlet, landed in the tree, to permit the hanger and tubing to be pulled without disconnection of the tree. In the case of a conventional tree, the tubing may be suspended from a hanger received within the coupling, the radially inner connection being with a casing hanger of the mudline suspension system.

Further preferred features and advantages of the invention are in the following description of illustrative embodiments, made with reference to the drawings.

DESCRIPTION OF THE PREFERRED EMBODIMENTS

Figure 1:
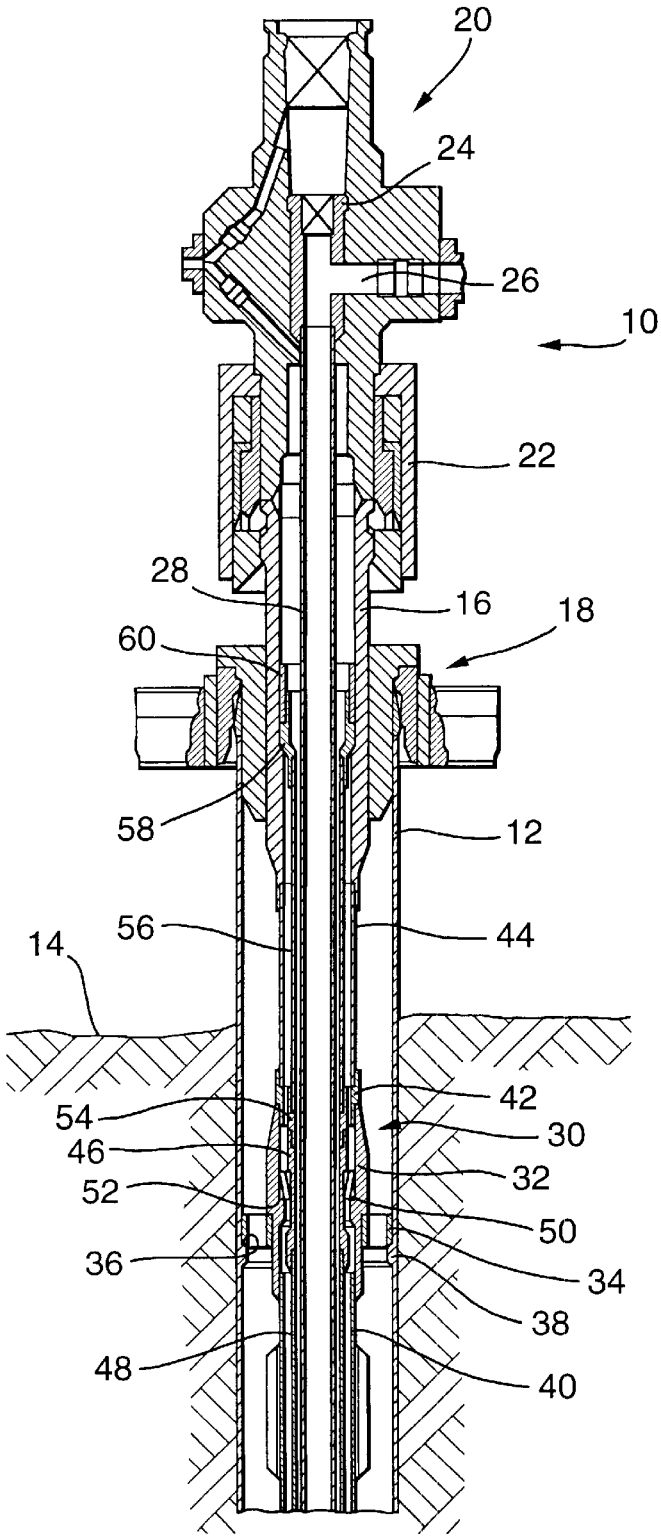
Fig.1. (Prior Art)
FIG. 1 is a schematic diagram of a prior art connection between a mudline suspension system and a subsea Christmas tree using an adapter wellhead.

The prior art completion 10 of FIG. 1 has a conductor casing 12 whose upper end terminates a short distance above the seabed 14. An adapter wellhead 16 is secured within the upper end of the conductor casing 12 by a rigidizing mechanism 18. A horizontal Christmas tree 20 is secured to the upper end of the adapter housing 16 by a clamp mechanism 22. A tubing hanger 24 having a lateral production fluid outlet 26 is landed within the tree 20 and supports tubing 28.

A mudline suspension system 30 is received within the conductor casing 12. The system 30 has an outer casing hanger 32 having a ported support flange 34 resting on a landing shoulder 36 formed on a sub 38 butt-welded into the conductor casing string 12. Casing hanger 32 suspends an outer casing string 40 and is tied back to the adapter wellhead by a tieback sub 42 and an adjustable tieback connector 44. Connector 44 takes up any variations in the axial spacing between the mudline suspension system 30 and the adapter wellhead 16.

A production casing hanger 46 of the mudline suspension system 30 nests within the outer hanger 32 and supports a production casing string 48. A ported flange 50 of production casing hanger 46 rests on a landing shoulder 52 formed in the bore of outer hanger 32. Hanger 46 is tied back to the adapter wellhead 16 by a tieback sub 54 and an adjustable tieback connector 56. The upper end of the tieback connector 56 is suspended from a further hanger 58 sealed within the adapter wellhead 16 by a packoff 60.

Various alternative arrangements for the mudline suspension system are known. For example, one or more of the mudline system casing hangers may be of the type including an annular suspension spring, which snaps into a receptacle inside the previously installed (next outer) casing hanger, once the spring and receptacle are brought into proper alignment. Additional casing hangers for suspending further casing strings may be nested between the production casing hanger and outer casing hanger, tied back to further hangers and packoffs received in the adapter wellhead.

Figure 2:
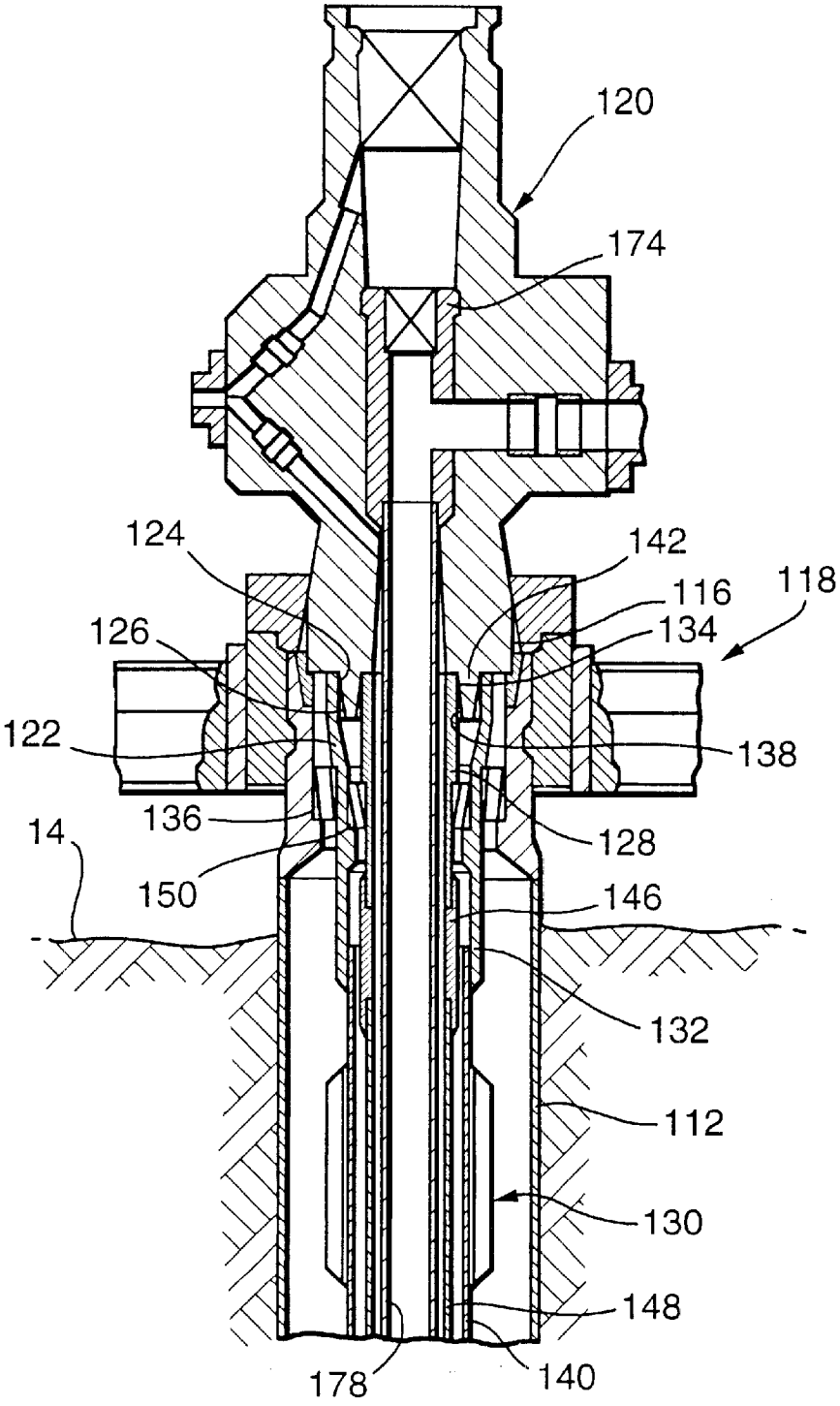
FIG. 2 schematically illustrates a first embodiment of the invention.

FIG. 2 schematically shows a horizontal Christmas tree 120 connected to a mudline suspension system 130 by a coupling embodying the present invention. A rigid joint is formed between a conductor casing 112 and a radially outer connection surface 116 formed at the lower end of the tree 120. Radially outer connection surface 116 is received within a conductor housing 114 welded to the upper end of the conductor casing 112, and is rigidly secured in the housing 114 by a clamp mechanism 118.

An outer casing hanger 132 having a ported support flange 136 is landed in the conductor housing 114 and supports an outer casing string 140. The outer casing hanger 132 has an upper extension 122 adapted to make a sealed joint with a radially inner connection surface 124 depending from the lower end of the tree 120. A seal ring (for example a weight set metal to metal sealing gasket) 126 is disposed between the hanger upper extension 122 and tree inner connection surface 124.

A production casing hanger 146 is landed within the outer casing hanger 132, and rests on a ported support flange 150, to suspend production casing 148. An upper extension 128 of the production casing hanger 146 is adapted to make a sealed joint with another radially inner connection surface 138 depending from the lower end of the tree 120. A seal ring 134 similar to the seal ring 126 is disposed between the production casing hanger upper extension 128 and the connection surface 138, to provide a continuous, sealed production annulus extending from the tree 120 down into the mudline suspension system 130. As shown, the connection surfaces 124, 138 comprise inner and outer surfaces of a depending skirt 142 formed on the lower end of the tree 120, although many other arrangements are readily possible.

Further casing hangers (not shown) may be nested between the outer casing hanger 132 and the production casing hanger 146, for suspending further casing strings. Other known mudline suspension casing hanger types may be utilized in carrying out the present invention including, but not limited to, suspension spring equipped hangers as discussed above in connection with FIG. 1. A tubing hanger 174 with a lateral production outlet is landed in the tree 120, to support a tubing string 178.

Figure 2A:
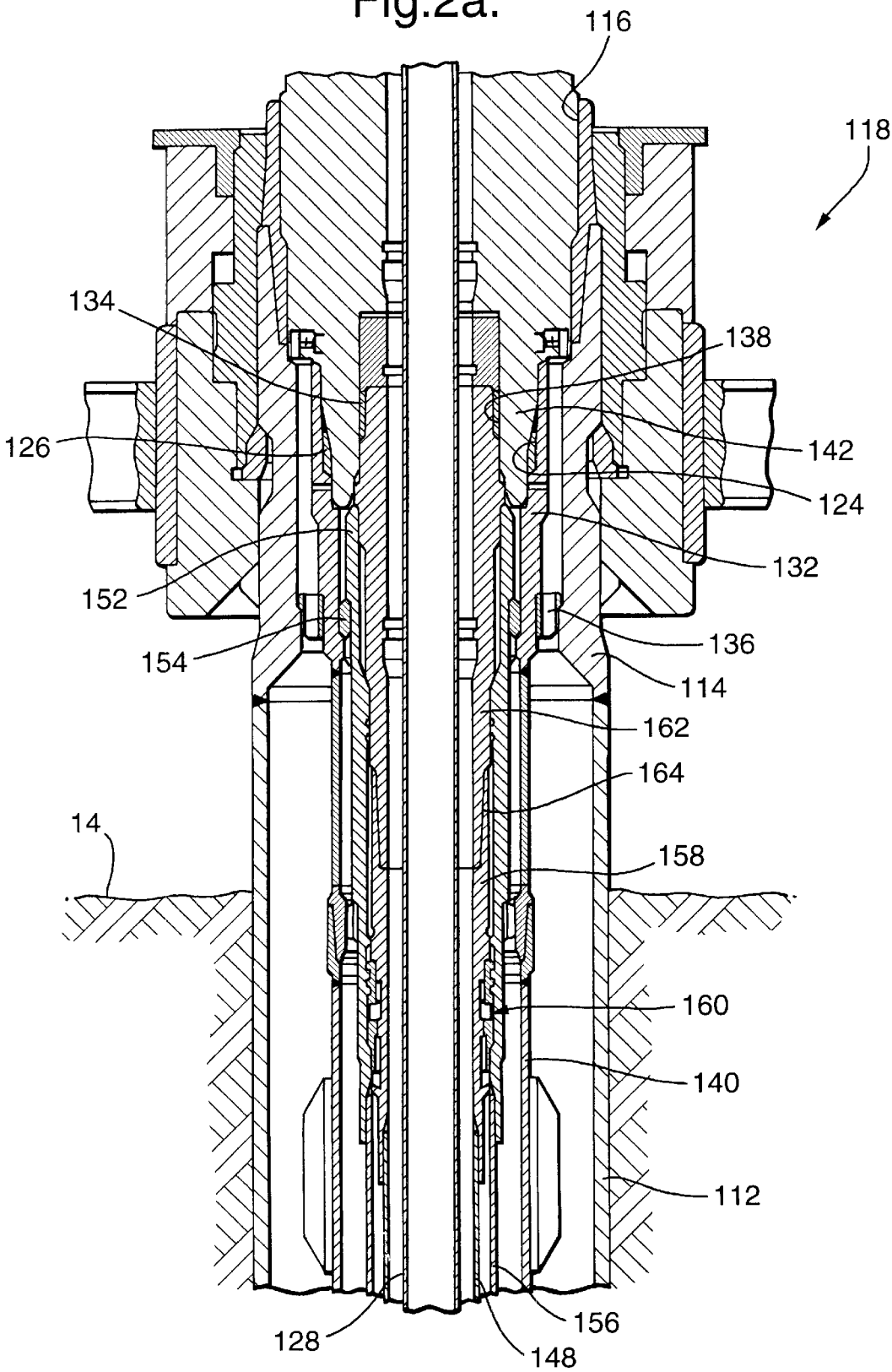
FIG. 2*a* shows a portion of a second embodiment in greater detail.

FIG. 2*a* again shows an outer casing hanger 132 supported in the conductor housing 114 on a ported flange 136 and sealed to the depending skirt 142 by seal ring 126. An intermediate casing hanger 152 is supported within the outer hanger 132 by a ported flange 154. An intermediate casing string 156 is suspended from the intermediate hanger 152. A production casing hanger 158 is locked in the intermediate casing hanger 152 by a suspension spring mechanism 160. An extension sleeve 162 is connected to the upper end of the production casing hanger 158 by threads 164. The extension sleeve 162 is sealed to the tree skirt 142 by seal ring 134.

Figure 3:
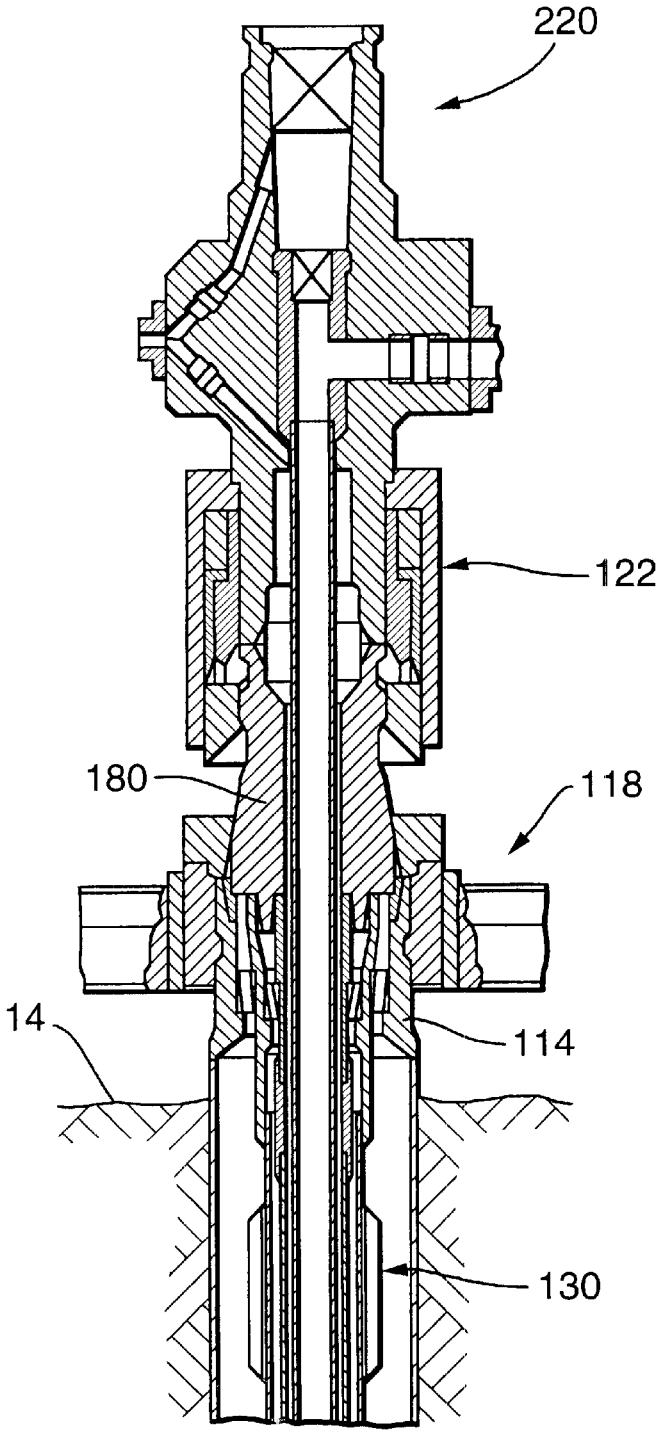
FIG. 3 schematically illustrates a third embodiment of the invention.

FIG. 3 schematically shows a modification of the FIG. 2 embodiment, in which the coupling with the mudline suspension system 130 and conductor housing 114 is made with a separate adapter spool 180 attached to a tree 220 by a clamp mechanism 122. The tree 220 may thus be an entirely conventional horizontal tree. In other respects, the embodiment of FIG. 3 is similar to that of FIG. 2. The FIG. 3 embodiment may also be modified to incorporate additional or alternative casing hangers as shown for example in FIG. 2*a*.

Figure 4:
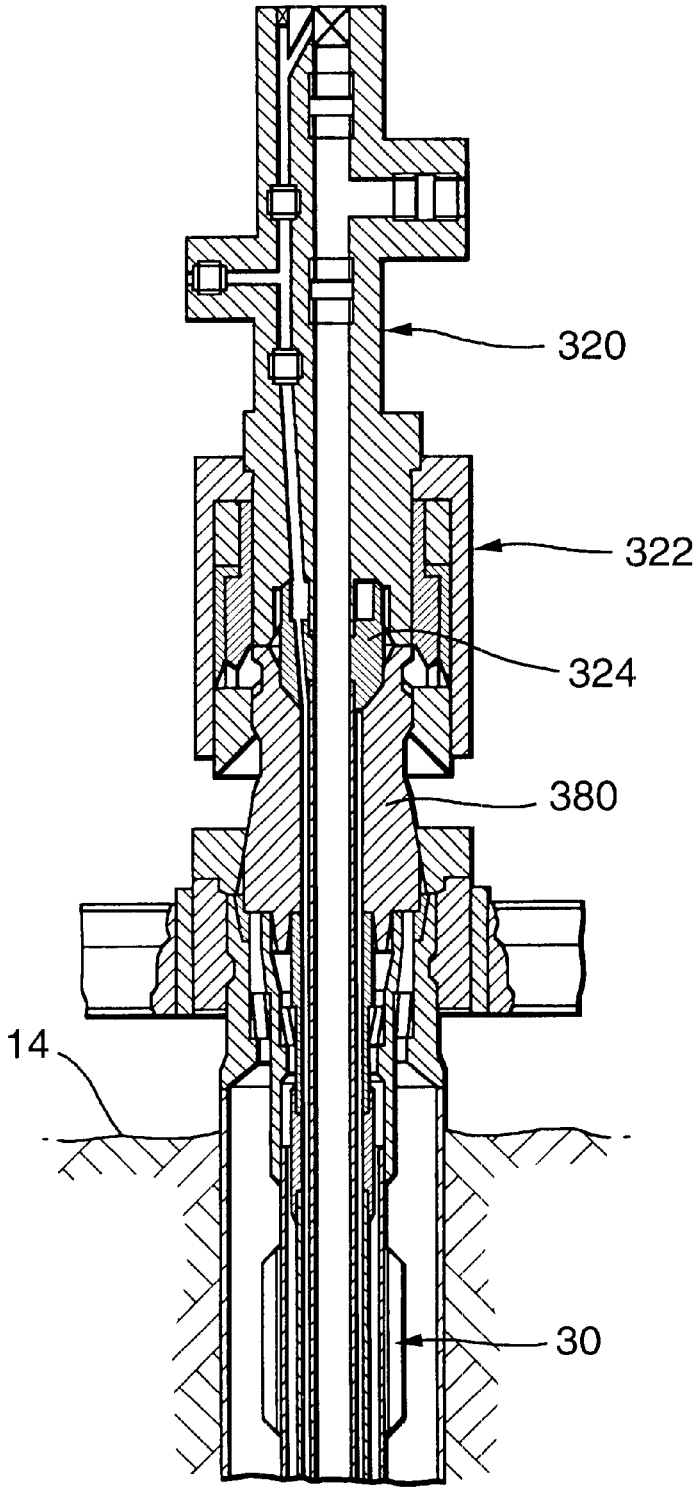
FIG. 4 schematically illustrates a fourth embodiment of the invention.

The invention may also be applied to the connection of conventional (i.e. non-horizontal) trees to a mudline suspension system, the tubing hanger being supported by the joint of the invention. As shown in FIG. 4, an adapter spool 380 receives a parallel bore tubing hanger 324. A conventional subsea tree 320 is mounted on the adapter spool 380 by a clamping mechanism 322, and is connected to the tubing hanger 324 in the conventional manner. The adaptor spool 380 is rigidly joined to a conductor casing and sealed to one or more casing hangers of the mudline suspension system 30 in like manner to the FIG. 2, 2*a* or FIG. 3 embodiments.

Although the disclosed invention is designed primarily for jack-up deployment, it can also be used for deeper water completions.

What is claimed is:

1. A subsea Christmas tree coupling assembly for directly mounting a subsea Christmas tree to a mudline suspension system without the use of a tieback hanger, comprising:

a radially outer connection surface of the subsea Christmas tree sealingly joined with an upper extension of an outer casing hanger; and a radially inner connection surface of the subsea Christmas tree sealingly joined with an upper extension of a production casing hanger.

2. A coupling assembly as defined in claim 1, wherein the radially outer connection surface is rigidly secured within a conductor housing attached to a conductor casing.

3. A coupling assembly as defined in claim 2, wherein the outer casing hanger is connected within the conductor housing to support an outer casing string.

4. A coupling assembly as defined in claim 3, wherein a seal ring is disposed between the upper extension and the radially outer connection surface.

5. A coupling assembly as defined in claim 4, wherein the seal ring is a weight set metal to metal sealing gasket.

6. A coupling assembly as defined in claim 3, wherein the production casing hanger is connected within the outer casing hanger, and contacting a ported support flange.

7. A coupling assembly as defined in claim 1, for use with a horizontal subsea Christmas tree, wherein a radially inner connection comprises one or more casing hangers of the mudline suspension system in use.

8. A coupling assembly as defined in claim 1, for use with a conventional subsea Christmas tree, comprising tubing suspended from a hanger received within the coupling.

9. A coupling assembly as defined in claim 1, further comprising a skirt formed at the lower end portion of the coupling, wherein a first connection surface defines an inner surface of the skirt and a second connection surface defines an outer surface of the skirt.

10. A coupling assembly as defined in claim 1, wherein a seal ring is disposed between the upper extension of the production casing hanger and the radially inner connection surface.

11. A coupling assembly as defined in claim 1, comprising a sealed production annulus extending through the coupling and the mudline suspension system.

12. A coupling assembly as defined in claim 1, further comprising a second casing hanger nested between the outer casing hanger and the production casing hanger, the second casing hanger suspending a second casing string.

13. A coupling assembly as defined in claim 1, further comprising:

a conductor housing welded to an upper end portion of a conductor casing;

an adapter spool attached to a lower end portion of the subsea Christmas tree, the adapter spool received within the conductor housing and having a peripheral connection surface adapted to contact at least a portion of an inner surface of the conductor housing; and a clamp mechanism for sealingly joining the adapter spool to the conductor housing.

14. A coupling assembly as defined in claim 13, wherein the adapter spool receives a parallel bore tubing hanger.

15. A coupling assembly as defined in claim 13, wherein the subsea Christmas tree is connected to a tubing hanger.

16. The subsea Christmas tree coupling assembly of claim 1 further comprising an adapter spool having a peripheral connection surface adapted to contact at least a portion of an inner surface of a conductor housing.

17. A coupling for mounting a subsea Christmas tree upon a mudline suspension system without the use of a tie back hanger, comprising:

a conductor housing rigidly attached to a conductor casing;

a subsea Christmas tree forming a skirt at a lower end portion of the subsea Christmas tree;

an outer casing hanger supported within the conductor housing, the outer casing hanger having an upper extension portion adapted to sealingly contact a first connection surface of the skirt; and a production casing hanger adapted to sealingly contact a second connector surface of the skirt.

18. A coupling as defined in claim 17, further comprising a seal ring disposed between the upper extension portion and the skirt.

19. A coupling as defined in claim 17, further comprising a seal ring disposed between the extension sleeve and the skirt.

* * * * *